US007540494B2

(12) United States Patent
Stemmle et al.

(10) Patent No.: US 7,540,494 B2
(45) Date of Patent: Jun. 2, 2009

(54) PAPER HANDLING SYSTEM FEEDER ADJUSTMENT FOR STACK ELEVATOR MECHANISMS

(75) Inventors: Denis J. Stemmle, Stratford, CT (US); Pascal Ferracani, Conches (FR); Mark D. Lee, Princeton Junction, NJ (US)

(73) Assignee: Pitney Bowes Inc., Stamford, CT (US)

( * ) Notice: Subject to any disclaimer, the term of this patent is extended or adjusted under 35 U.S.C. 154(b) by 498 days.

(21) Appl. No.: 11/118,250

(22) Filed: Apr. 29, 2005

(65) Prior Publication Data

US 2006/0244198 A1 Nov. 2, 2006

(51) Int. Cl.
*B65H 1/00* (2006.01)

(52) U.S. Cl. ..... 271/171

(58) Field of Classification Search ..... 271/241, 271/162, 171; 399/391, 393, 405
See application file for complete search history.

(56) References Cited

U.S. PATENT DOCUMENTS

| | | | | |
|---|---|---|---|---|
| 3,357,700 | A * | 12/1967 | Bradicich | 271/130 |
| 4,772,007 | A * | 9/1988 | Kashimura | 271/22 |
| 5,634,634 | A | 6/1997 | Dobbertin et al. | |
| 6,746,012 | B2 * | 6/2004 | Diews | 271/164 |
| 6,793,215 | B2 | 9/2004 | Salomon | 271/171 |
| 2002/0096820 | A1 * | 7/2002 | Diews | 271/171 |
| 2003/0234486 | A1 * | 12/2003 | Taku | 271/264 |

FOREIGN PATENT DOCUMENTS

| | | | |
|---|---|---|---|
| EP | 1055623 | A2 | 11/2000 |
| JP | 05319584 | A | 12/1993 |
| JP | 09002675 | A | 1/1997 |
| JP | 10-35895 | * | 2/1998 |
| JP | 2001-253552 | * | 9/2001 |
| JP | 2004-115168 | * | 4/2004 |

* cited by examiner

*Primary Examiner*—Patrick H Mackey
*Assistant Examiner*—Thomas A Morrison
(74) *Attorney, Agent, or Firm*—Ronald Reichman; Angelo N. Chaclas

(57) ABSTRACT

A media feeder for feeding media items includes a moveable media side guide. A force limiting mechanism is coupled to move the side guide such that the side guide can be moved into engagement with media items with a force that will not exceed a predetermined level. A second mechanism is coupled to move the side guide a predetermined distance away from the media items. In one arrangement a first and a second moveable media side guides are mounted adjacent a media elevator platform. A first force limiting drive means is connected to a side guide adjustment mechanism operable to cause the guides toward or away from each other. A second drive means is connected to the side guide adjustment mechanism and is operable to cause the side guide adjustment mechanism to move the guides such that a predefined gap is established between the media items on the platform and the side guides after the side guides are moved into engagement with the media items. The second drive means may be operated by movement of an operator operable member such as cover for a media elevator platform housing. The feeder side guides may be adjusted to the predefined gap by a method that includes the opening and closing of the of the media elevator platform housing cover.

11 Claims, 6 Drawing Sheets

PAPER HANDLING SYSTEM FEEDER ADJUSTMENT FOR STACK ELEVATOR MECHANISMS

FIELD OF THE INVENTION

The present invention relates to paper handling systems, such as folders, inserters, printers and copier systems, and more particularly, to a feeder adjustment for a paper stack elevator mechanism.

BACKGROUND OF THE INVENTION

Various products require media feeders for different types of media to be processed by a paper handling system. Media feeders for envelopes, sheets, inserts and the like are used in various equipment, such as folders, inserters, printers and copiers. A common problem in feeders for equipment of this type is a high fault rate in feeding media. This is because the adjustment of the media side guides is often highly dependent on operator skill in making the required adjustment. If the operator sets the side guides too tight, mis-feeds frequently occur. The setting of side guides too tight against the stack of media can also cause the erratic performance in the stack elevator mechanisms used for moving the media to be in engagement with the singulator and feeder mechanisms.

If the operator sets the side guides too loose, then the envelopes can skew and become offset while they are being fed. This can create errors in printing registration and folding operations, as well as jams in the equipment and other related problems. For some feeders, when the side guides are set too loose, the rate of multi-feeding may increase. Incorrectly setting side guides results in higher rates of many types of machine faults and shutdowns. Operators often gain experience in setting the side guides by trial and error; however, having experienced operators are often more highly paid, which can increase the cost of operating the equipment, particularly high speed equipment where there may be frequent need for replenishing the media, as for example, on high speed copiers, laser printers, addressing machines and other types of imaging and office equipment. In situations where experienced operators move on to other jobs and are replaced by inexperienced operators, the inexperienced operator must acquire the knowledge and skill required for optimal adjustments to feeder side guides. Often this process is again accomplished by trial and error, resulting in unsatisfactory performance of the feeder until the operator obtains the requisite skill in adjusting the side guides. These problems occur in both center registered and also in edge registered type media feeders. For typical media processing systems, when the media is center registered, both side guides are adjusted. When the media is edge registered, typically only one side guide is adjusted.

Various techniques have been provided to help assist operators in setting the adjustment. For example, with well-controlled known standard sizes, such as 8½×11 (letter), 8½×14 (legal) size sheets, as well as other size sheets, detents have been provided in assisting in setting the side guides. While the tolerances of standard cut sheet letter size media is typically quite reliable with a tolerance of +/−0.5 mm. However, the size tolerances for envelopes, inserts and pre-printed sheet media are often not as accurate and can be unpredictable, frequently having variations of +/−2-3 mm. Accordingly, the provision of detent-type solutions in positioning the side guides for media of this type will not be satisfactory because of the high tolerances in the media dimensions. For example, if a detent is designed to locate the side guide for an average envelope size, and envelope having a tolerance on the large side of nominal could be compressed by 3 mm, which will significantly increase the rate of mis-feeds. Alternatively, if the detent is located at the maximum tolerance to accommodate the envelopes with the largest positive tolerance, when envelopes with the largest negative tolerance are loaded, it will result in a gap of 6 mm between the stack of envelopes and the side guide. This large gap will result in a significantly higher number of skewed feeds, which can increase the number of jams and other types of faults downstream in the process. Besides jams, some typical faults associated with skewed feeds include misaligned images on the media in the case of a printing system, or increased insertion faults in the case of an insertion system. In cases such as this, at times various operator aids to set the side guides are employed such that the gap between the side guides and the edge of the material is appropriately adjusted. In some systems, in order to compensate for the lack of operator skills in adjusting feeder side guides, expensive mechanisms are added to de-skew the envelope, and sometimes to re-center the envelope before moving it down stream for printing or insertion.

In high capacity feeders that typically employ an elevator mechanism, the problem is compounded. The operator often may load the feeder tray in several steps. The operator frequently loads several handfuls or reams of media in discrete steps. In such a situation, each handful loaded may not be perfectly aligned with the previously loaded handful. Batches of the media in the stack can thus be slightly offset from other batches loaded into the feeder. Also, the entire stack can be slightly skewed between the side guides. If the operator moves the side guides tightly against the edges of the media after the stack of media has been loaded into the feeder in order to push all individual batches toward the center until the edges are aligned, this may correct the situation. But, often, as a result, this operator action to correct the misalignment of the stack often leads the side guides being set too snug against the edges of the stack. This can cause mis-feed failures or elevator mechanism failures. A similar type of problem also occurs in low capacity feeders in which a single handful or ream of media may be loaded in the feeder if the media is not placed perfectly centered between the side guides. In such case the operator may use the adjustment of the side guides to center the stack, which results in a similar type of problem noted above in connection with high capacity media feeders, where the guides are too snug against the edge of the stack.

The problem of adjusting the media guides has been noted in U.S. Pat. No. 6,793,215B2 for "Self-Adjusting Side Guide in Mail Handling Device." The patent discloses a self-adjusting guide, which is provided for a document-handling machine having a feed deck along which documents are transported. The self-adjusting side guide includes a member mounted for movement along the feed deck toward and away from the documents. A side guide self-adjusts to correct the drag effect problem.

SUMMARY OF THE INVENTION

The present invention provides an arrangement for setting the side guides in the correct position for media feeders, which results in significant improvement in the performance of the system and enables untrained operators to be as proficient as trained operators in setting the side guides. The present invention provides improvements for both center registered and edge registered type media feeders.

The present invention is particularly useful in feeders where the material is loaded onto a feeder platform, where the material may be mis-aligned with respect to the side guides and in high capacity feeder arrangements where the material is be loaded into the feeder in batches to completely fill the feeder.

The present invention provides enhanced operation of the feeders for paper handling systems where an operator opens a feeder closure and loads a stack of media between the side guides. The operator adjusts a mechanism until the side guides are snug against the media stack. The adjustment includes a clutch arrangement, which will slip if the operator sets the guides too snugly against the media stack. The operator then closes the feeder closure and the mechanism associated with the closure acts to back the side guides away from the stack of media a required amount for appropriate operation of the feeder and appropriate operation of the elevator mechanism. In accordance with the invention, the force exerted by the operator in making the adjustment is sufficient to align mis-aligned media such that the back-off of the side guides is sufficient to allow proper feeding. The clutch limits the force with which the side guides can be moved against the media stack.

A media feeder embodying the present invention for feeding media items includes a moveable media side guide. A force limiting mechanism coupled is to move the side guide such that the side guide can be moved into engagement with media items with a force that will not exceed a predetermined level. A second mechanism is coupled to move the side guide a predetermined distance away from the media items.

In another embodiment of the present invention, a media feeder for feeding media items from a stack of media items includes a media feed means for separating and feeding a single media item from a stack of media items. A first and a second moveable media side guides are mounted adjacent a media elevator platform. The media elevator platform is moveable toward and away from the media feed means. A media side guide adjustment mechanism is connected to the first and the second side guides such that when the adjustment mechanism is moved in a first direction the first and second side guides will move toward each other and when the adjustment mechanism is moved in a second direction the first and said second side guide will move away from each other. A first drive means is connected to the side guide adjustment mechanism and is operable to cause the side guide adjustment mechanism to move in the first and the second direction. A second drive means is connected to the side guide adjustment mechanism and is operable to cause the side guide adjustment mechanism to move a predetermined amount in the second direction such that a predefined gap is established between media items on the platform and the a first and a second moveable media side guides after the side guides are moved into engagement with the media items.

In still another embodiment of the present invention a media feeder for feeding media items includes a media feed mechanism. A media elevator platform is mounted for supporting media items and is within a housing. The housing includes a hinged cover. The media elevator platform moveable in a vertical direction toward and away from the media feed mechanism. A first and a second media side guide are mounted adjacent the media elevator platform and are moveable in a horizontal direction. An adjustment mechanism, such as a lead screw, is connected to the first and the second side guides such that when the adjustment mechanism is moved in a first direction the first and second side guides will move toward each other and when the adjustment mechanism is moved in a second direction the first and said second side guide will move away from each other. A first drive mechanism is connected to the adjustment mechanism and operable to cause the adjustment mechanism to move in the first and the second direction. A second drive means is connected to the housing cover and to the adjustment mechanism and is operable to cause the adjustment mechanism to move in said the direction when the cover is opened and in the second direction when the cover is closed.

A method for adjusting media side guides embodying the present invention includes the steps of opening a media feeder housing cover and loading a stack of media items onto a feeder elevator platform within the housing. Moving media side guides are through a force limiting drive arrangement into engagement with the sides of the stack of media items, the force being sufficient to align misalinged media items on the feeder elevator platform. Causing the media side guide drive to be operated by closing the housing cover such that the side guides move away from the stack of media items to establish a gap between the stack of media items and the side guides.

BRIEF DESCRIPTION OF THE DRAWINGS

Reference is now made to the figures wherein like reference numerals designate similar items in the various views and in which.

DETAILED DESCRIPTION OF THE PREFERRED EMBODIMENT

Figure 1:
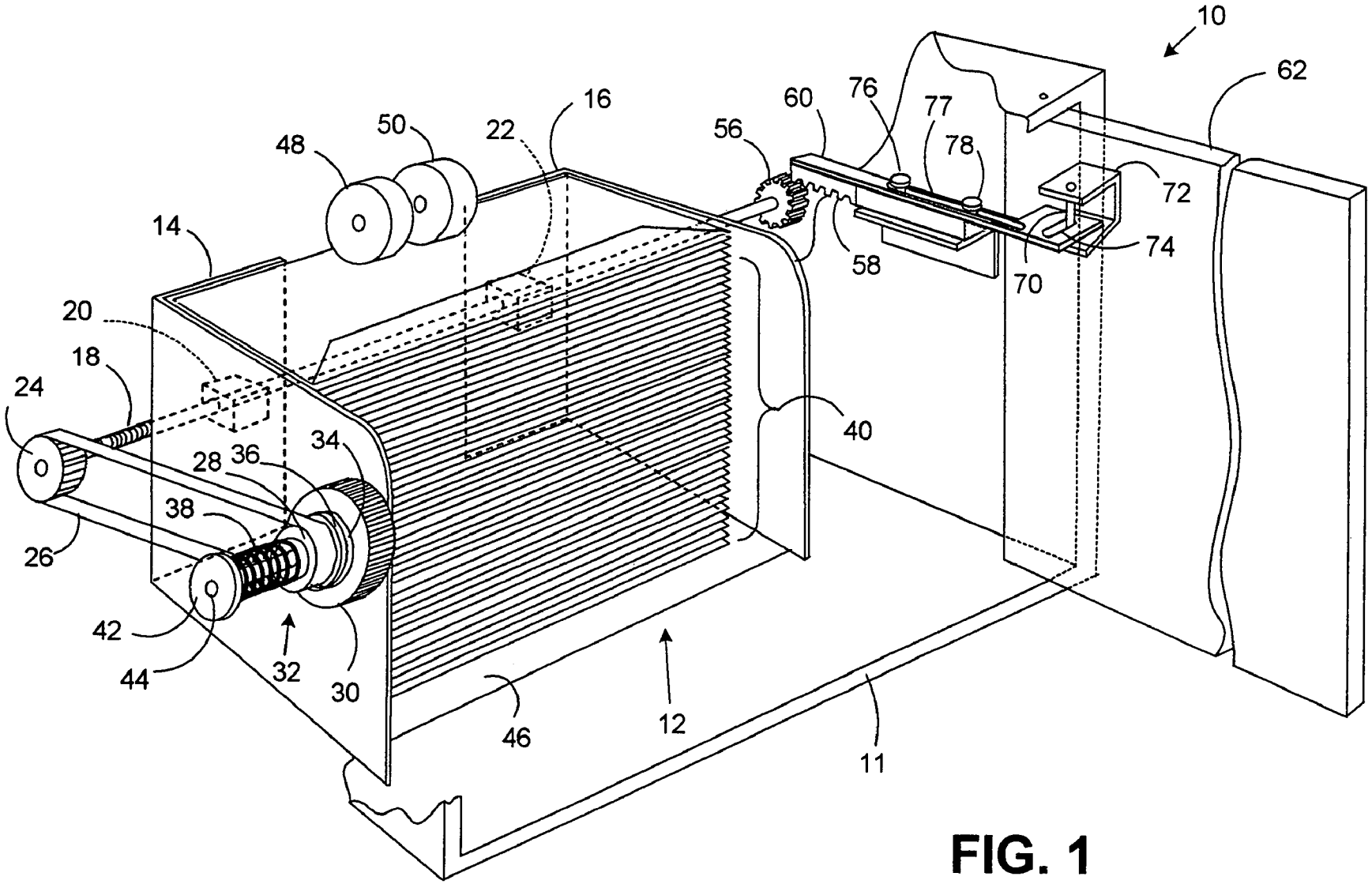
FIG. 1 is a perspective view of a paper handling system with a media feeder with a media stack elevator mechanisms and a moveable side guide adjustment arrangement embodying the present invention.
Figure 2:
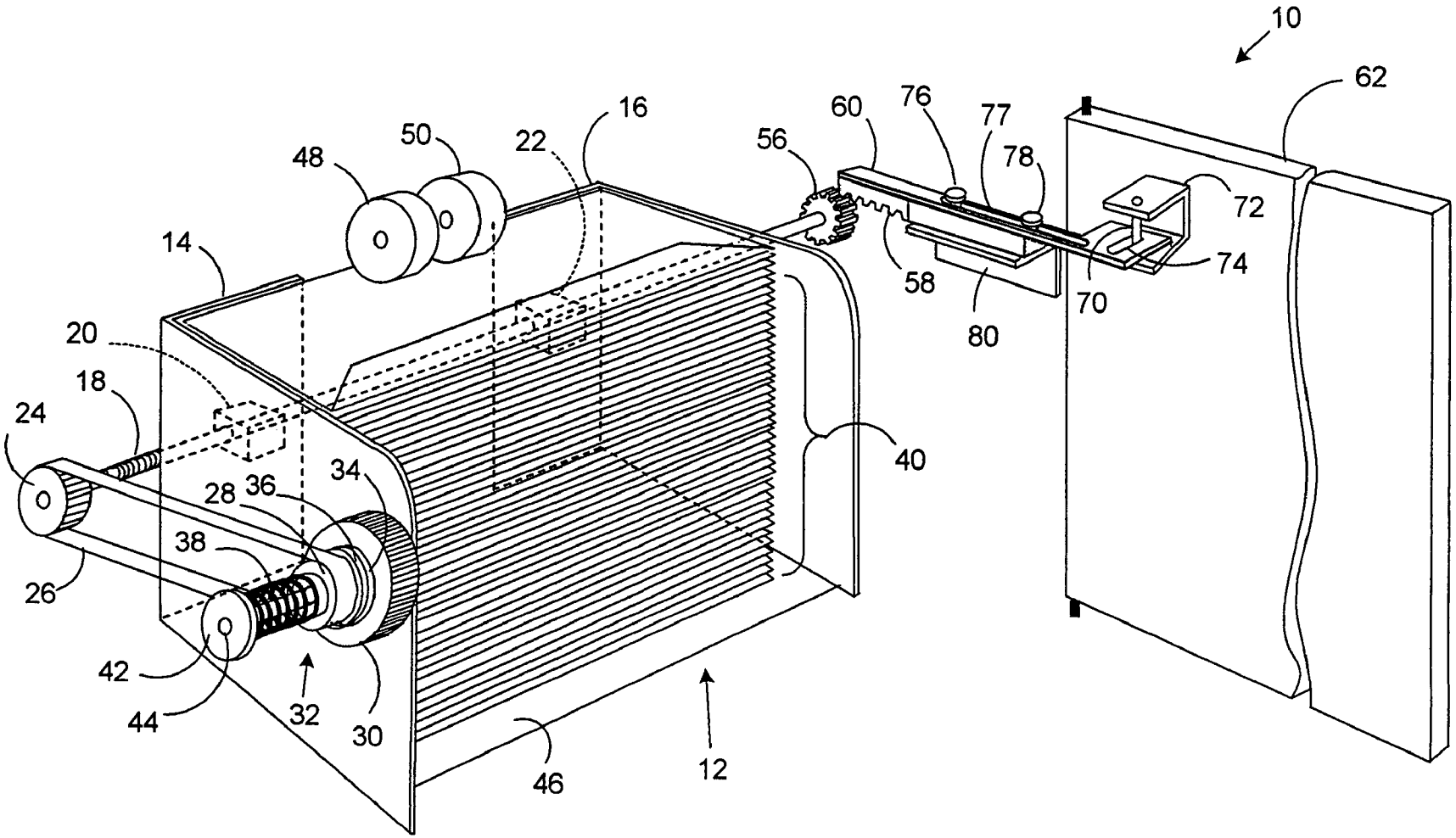
FIG. 2 is a perspective view of those parts of the feeder shown in FIG. 1, helpful in an understanding of the present invention with an aligned stack of envelopes on the feeder media support elevator platform and with the feeder cover in the fully open position.

Reference is now made to the various figures and more particularly to FIG. 1. A paper handling system 10 has a feeder housing 11 that encloses a media feeder 12. Depending on the design, the housing 11 may partially or fully enclose the media feeder 12. The media feeder 12 includes moveable media side guides 14 and 16. A lead screw 18 is threaded through a member 20 attached to side guide 14 and a member 22 attached to side guide 16. The lead screw 18 has a left-hand thread associated with one of the side guides and the right-hand thread associated with the other of the side guides. Thus, when lead screw 18 is rotated, the side guides 14 and 16 will move toward each other or away from each other, depending upon the direction the lead screw 18 is turned. The side guides can be connected by other arrangements, such as using gear segments, or opposing racks, which engage a single pinion to cause both side guides to move toward or away from the center of the paper path. These and other arrangements can be incorporated into the present system.

It should be noted that the present system can also beneficially be employed where only one side guide is adjusted. For example with edge-registered systems, only one side guide is moved to accommodate different sizes of media. However, the same type limitations apply regarding the setting of a gap between the media and the adjustable side guide. Accordingly, the present system is applicable to such arrangements where only one media guide is adjusted and similar performance improvements will be obtained as for center-registered systems.

A pulley 24 is affixed to the lead screw 18 and a belt drive 26 is used to transmit torque from a second pulley 28 connected to an adjustment thumb wheel 30 by a slip clutch shown generally at 32 and including two clutch faces 34 and 36. Clutch face 34 is affixed to adjustment thumb wheel 30 and clutch face 36 is affixed to pulley 28. A spring 38 provides a normal force between the two clutch faces 34 and 36. The arrangement provides a torque limiting mechanism. Other types of torque or force limiting mechanisms can be employed to provide the needed functionality.

The force of spring 38 and coefficient of friction of the clutch faces 34 and 36 act together to establish the magnitude of toque that can be transmitted through the clutch faces. Thus, when the operator turns the adjustment wheel 30, torque is transmitted through clutch faces 34 and 36 to the pulley 28, which drives the belt 26, to turn the lead screw 24. This results in movement of the side guides. The direction of movement depends upon the direction of rotation of the adjustment thumb wheel 30 and thus the direction of rotation of the lead screw 18. When the side guides are moved toward the stack of media 40, shown as envelopes, and eventually contact the edge of the stack of media 40, resistance will be transmitted back through the belt 26 to the adjustment wheel 30. When the resistance becomes sufficiently high, clutch faces 34 and 36 slip. Slip clutch 32 no longer transmits torque from the adjustment wheel 32 to the lead screw 18, and movement of the side guides 14 and 16 stops.

The value of the torque at which the clutch 32 slips may be pre-established for correcting a situation in which an operator loads media into the feeder 12, and the edges of the media are not well aligned. One of the functions of the side guides 14 and 16 adjustment is to press against the edge of the stack to align the media if needed. A certain amount of force is required to accomplish this alignment depending on the specific parameters of a particular feeder design, such as the maximum stack capacity, the method of feeding, and the type of media to be fed. For a particular feeder design, test data will be used to establish the forces required to align the stack. Components of the clutch assembly, such as the materials of the clutch faces, spring force, and spring compression, will be selected as part of the design to accomplish the necessary adjustment force. It may be that the torque on the clutch 32 is adjusted at the factory to achieve this desired force by tightening nut 42, which captures the spring 38 and may be tightened on shaft 44 to increase the force exerted by the spring on the clutch faces 34 and 36. This adjustment will accomplish the objective of providing both sufficient torque to align the stack when the side guides are adjusted toward the stack, and then slip if the operator attempts to apply more torque than is necessary to align the stack.

Figure 6:
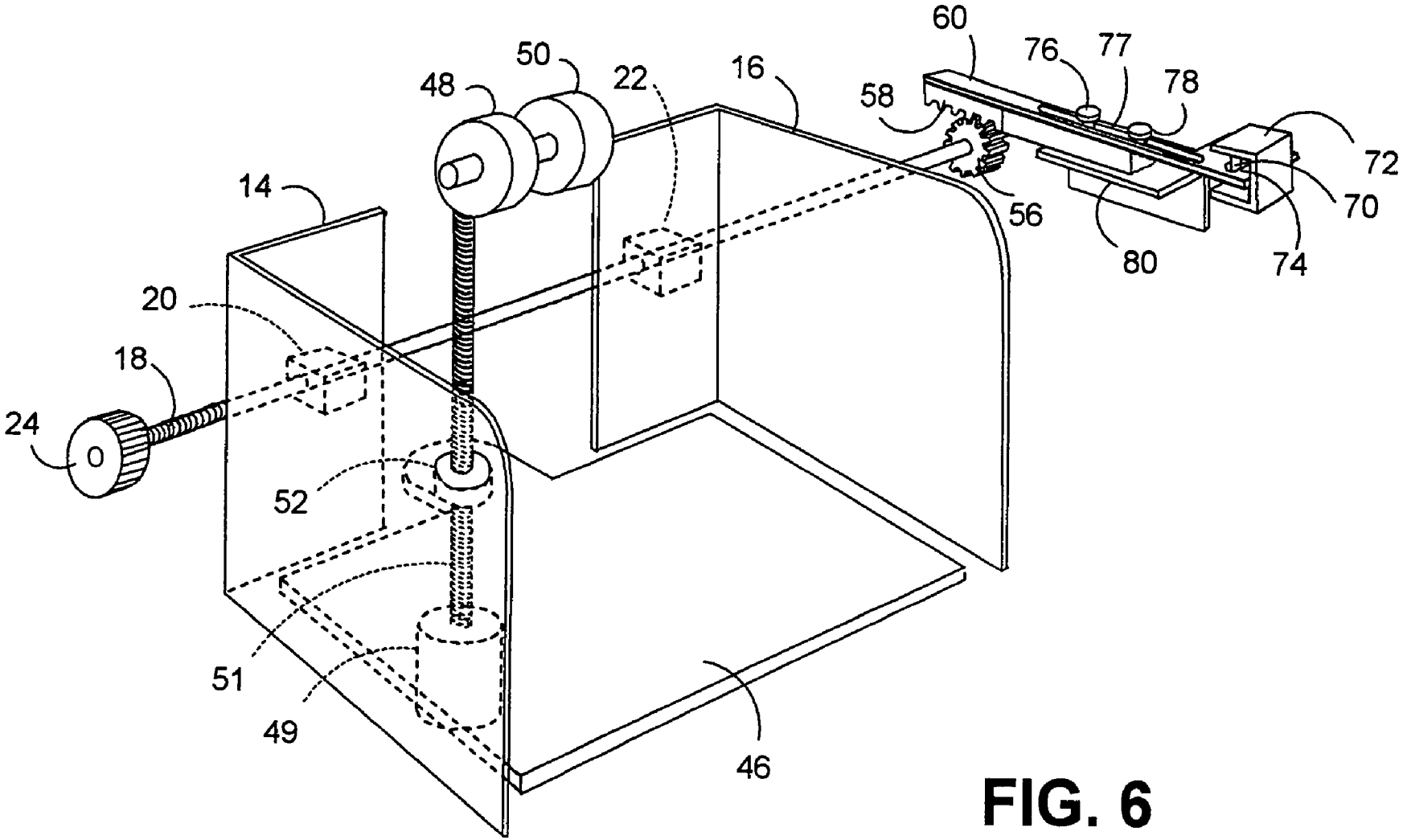

Other factors affect the feeder performance. The media 40 rests on a media support elevator platform 46 that must raise the stack of media 40 to the feed rollers 48 and 50 or other suitable media feed mechanisms, such as feed belt arrangement, in order to initiate feeding. When the side guides 14 and 16 have been moved to align the edges of the stack 40, the result is a high drag force between the side guides 14 and 16 and the media stack 40 when the stack 40 is lifted by the elevator motor 49 (FIG. 6) operating to rotate a lift screw 51 to lift the elevator platform 46 via a lift nut 52 attached to the platform 46. If the drag forces created by the adjustment of side guides 14 and 16 create a drag that is too high, the elevator motor 49 will stall. Additionally, drag of the stack of media against the side guides while the elevator is operating may cause the edges of the media near the top of the stack to be bent in a direction opposite the direction of elevator motion. This distortion in the edges of the media could result in a higher rate of mis-feeds and multi-feeds.

The problems of inappropriately adjusting the side guides 14 and 16 so that they are left in a position too snug against the edge of the stack of media are avoided in the present arrangement by automatically backing off the side guides 14 and 16 away from the media stack 40 after the stack has been aligned. A pinion gear 56 is attached to the lead screw 18. A rack gear 58 mounted on a sliding arm 60 is operated in a linear movement to turn the pinion gear 56. The linear motion of the sliding arm 60 and rack gear 58 is provided by the motion of a cover 62, which encloses the media stack 40 and is moveably attached, such as being hinged to the feeder housing 11 as shown in FIG. 1. It should be noted that the cover 62 could be a door or a different type moveable member, such as a lever, associated with the feeder. Depending on the design, the closeable cover may partially or fully cover the media 40 when it is placed in the feeder 12. When the cover 62 is opened, the sliding arm 60 and the rack gear 58 are moved in a first direction. This movement turns the pinion gear 56 and lead screw shaft 18 a small amount. This rotation causes the side guides 14 and 16 to move toward each other a small amount.

When the cover 62 is opened, the operator may load a stack of media and adjust the position of the side guides 14 and 16 by turning the adjustment thumb wheel 30 until the value of the slip torque of the clutch 32 is achieved as described above and clutch faces 34 and 36 slip, so that the side guides are snug against the stack of media 40. When the cover 62 is closed, the sliding arm 60 and rack gear 58 are moved in a second direction, which turns the pinion gear 56 and lead screw 18 in a second direction, which moves the side guides 14 and 16 away from the media stack 40 a small distance. One suitable distance may be, for example, about 0.5 mm. After these steps are completed, the stack of media 40 has been well aligned and the side guides 14 and 16 have been moved away from the stack of media items 40 so that no drag will occur between the side of the stack and side guides 14 and 16. Thus, there will be no additional drag to be overcome by the elevator motor 49 as it lifts media support elevator platform 46 and no additional drag on the top item of the media stack 40 when it engages feed rollers 48 and 50, which might contribute to mis-feeds. And media skew during the feeding operation will be limited. This results in a significant improvement in performance of the feeder 12 and facilitates utilization of the equipment by operators without training or experience in the appropriate positioning of side guides for proper operation.

Figure 3:
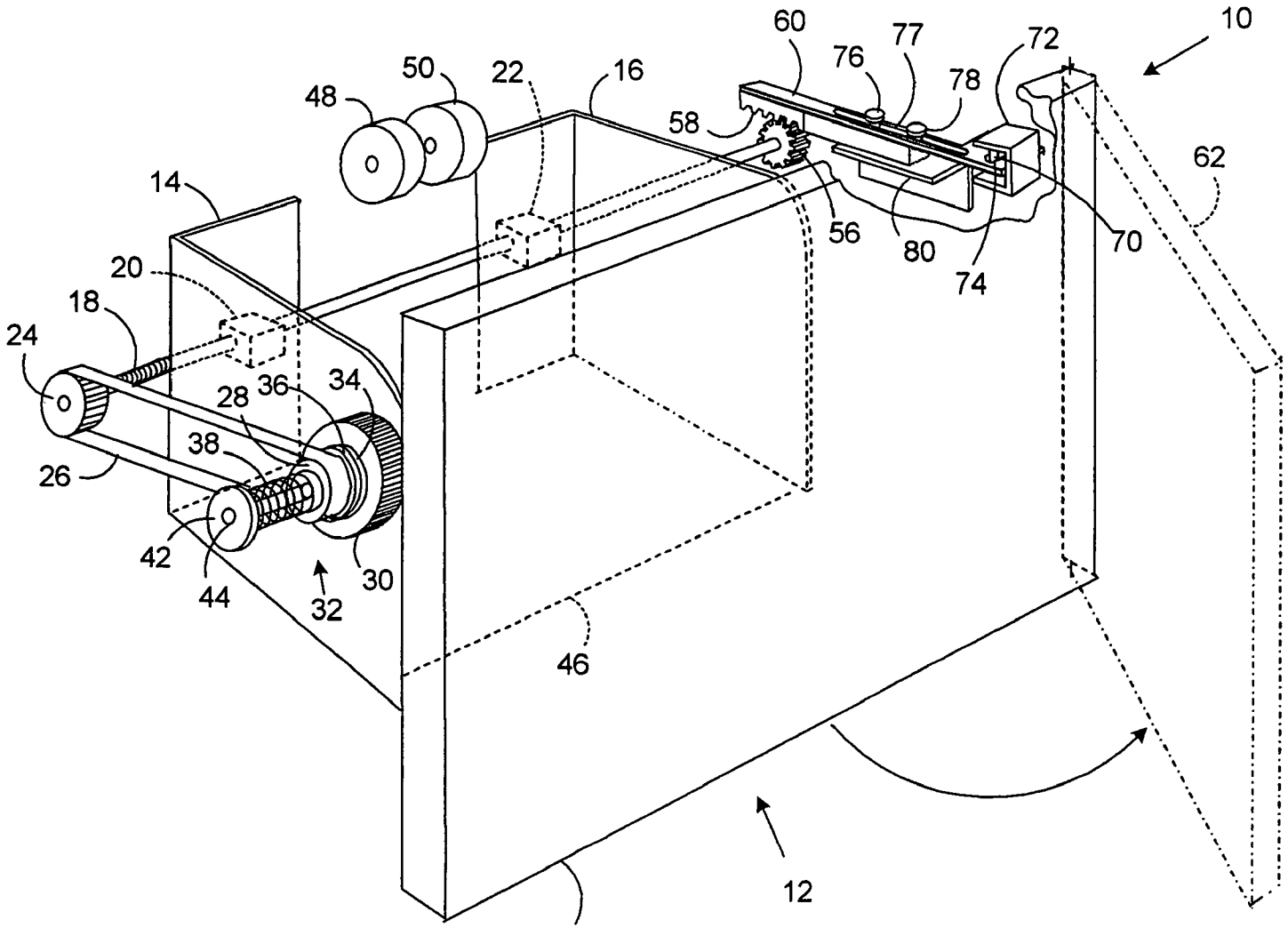
FIGS. 3-5 are perspective views of those parts of the feeder shown in FIG. 1, helpful in an understanding of the present invention and the sequence of operation to adjust the feeder moveable side guides, and showing the feeder cover in the fully closed position in FIG. 3, showing the feeder cover in the fully opened position with a misaligned stack of envelopes on the elevator support platform in FIG. 4, and showing the feeder cover in the fully closed position in FIG. 5; and, FIG. 6 is a perspective view of the feeder shown in FIGS. 1-5 showing details of the feeder elevator mechanism drives.
Figure 4:
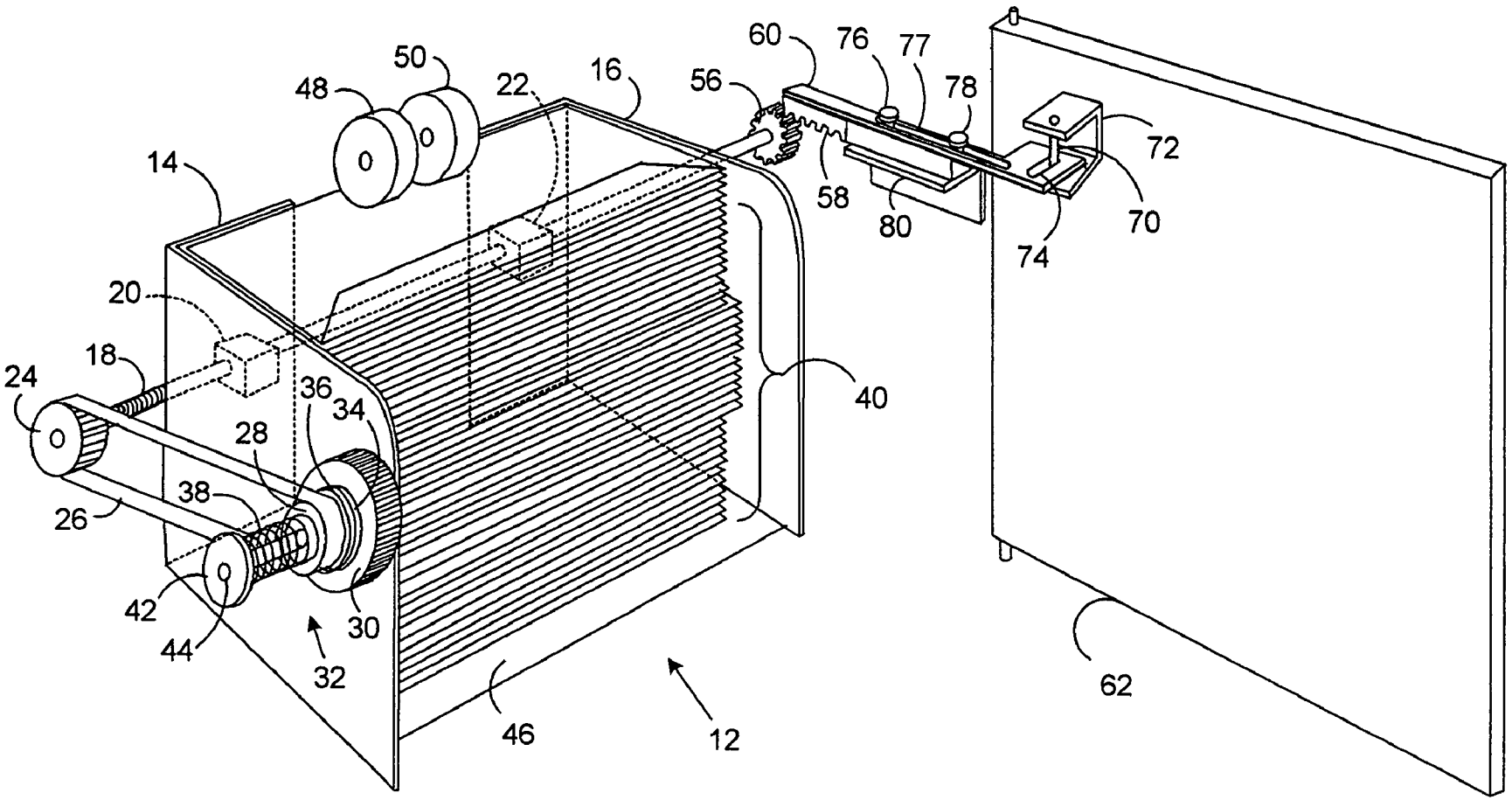
Figure 5:
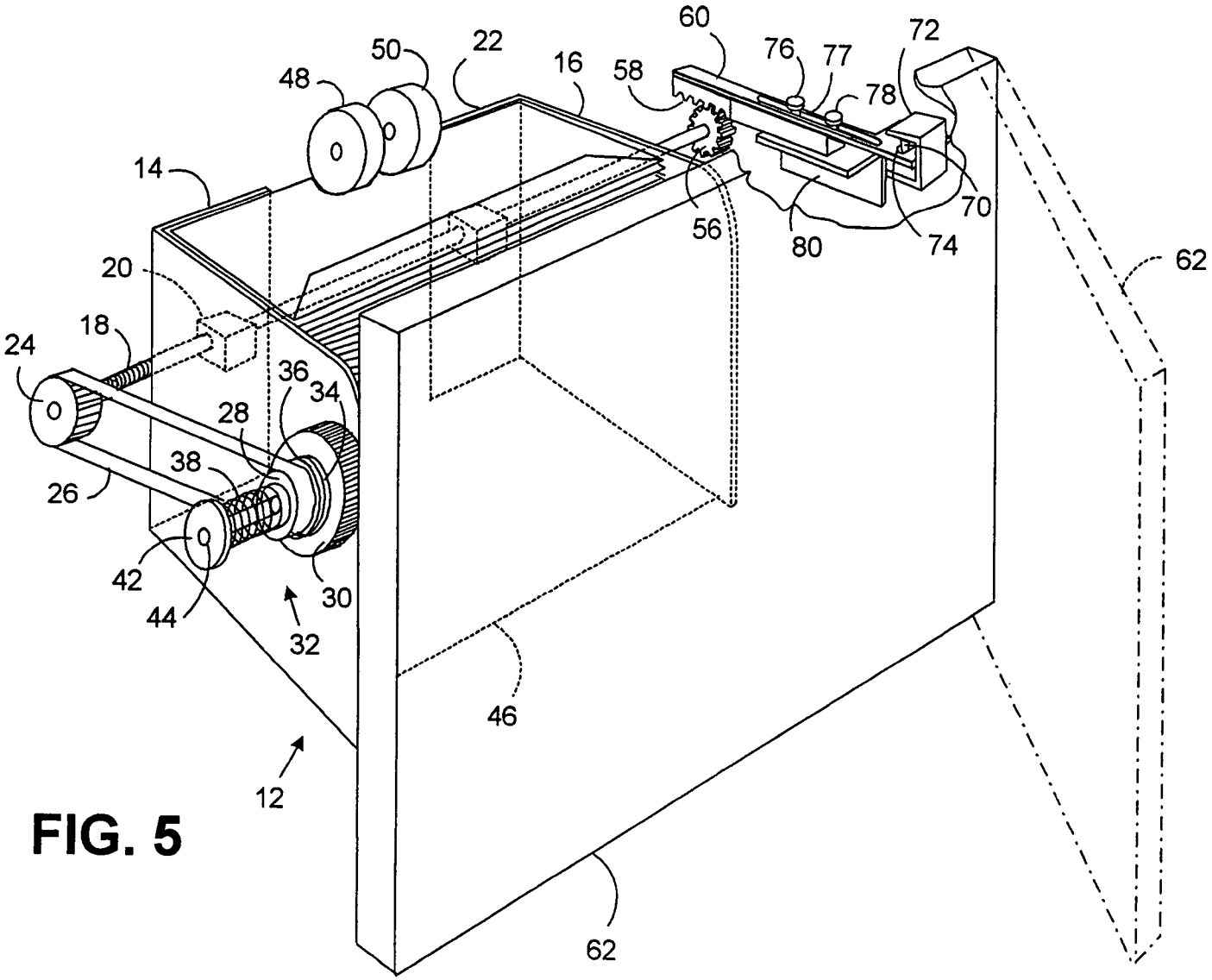

In operation as shown in FIGS. 3, 4 and 5, as the cover 62 swings open to the position shown in phantom, the sliding arm 60 with the rack gear 58 is pulled outwardly by a pin 70 attached by U-shaped bracket 72 connected to cover 62. During the opening and closing of the cover 62, the pin 70 rides in a slot 74 of the sliding arm 60. The rack gear 58 on the sliding arm 60, in contact with the pinion gear 56, causes the lead screw 18 to rotate as the sliding arm 60 is guided in a linear movement by the slot 77 which is mounted to guides 76 and 78. The guides 76 and 78 are connected to a bracket 80 mounted to the feeder housing 11. A suitable rotation for the pinion gear 56 may be in the range of 70-100°. This action on the lead screw 18 causes the side guides to move toward each other about 0.5 mm, depending upon the dimensions, including the threads and gear ratios of the various parts.

As shown in FIG. 4, when the cover 62 is fully opened, the rack gear 58 mounted on the sliding arm 60 is fully disengaged from the pinion gear 56 on the right end of the lead screw 18. At this time, the operator loads the media 40, shown in FIG. 4 as mis-aligned, and then adjusts the position of the side guides 14 and 16 by turning the adjustment thumb wheel 30. In order to align the media stack 40, as shown in FIG. 4, the thumb wheel 30 is operated until the slip torque associated with the clutch 32 is reached. This torque is sufficient to move the media stack 40 into good alignment. If the operator continues to rotate the thumb wheel 30 and tries to add additional pressure or squeeze the stack of media 40 too tightly, the slip clutch 32 will no longer transmit further rotary motion to the pulley 24 and thus lead screw 18. The side guides 14 and 16 will stop moving regardless of how much the operator rotates the adjustment thumb wheel 30.

As shown in FIG. 5, as the cover 62 swings closed from its open position shown in phantom, the sliding arm 60 moves the rack gear 58 back into engagement with the pinion gear 56. This causes the lead screw 18 to rotate. This action on the lead screw 18 causes the side guides 14 and 16 to move away from the stack of media to establish a predetermined gap for feeding media items from the media stack 40. When there is a sufficient gap between the gap of the edge of the media stack 40 and the side guides 14 and 16, for example 0.5 mm, it reduces the drag in order to minimize the stack elevator drive torque required for elevator motor 49 to lift the media support platform 46 and prevents mis-feeds, while simultaneously limiting the amount of skew on the media as they are fed from the stack of media 40. The predetermined distance from the edge of the stack 40 for each side guide 14 and 16 caused by closing the cover 62 will typically be small such as within the range of 0.2 mm to 1.0 mm, in contrast to the movement of the side guides caused by the operation of the adjustment thumb wheel 30 where the distance from the edge of the stack 40 for each side guide 14 and 16 to facilitate the loading on the media stack 40 onto the media support elevator platform 46 will be whatever distance is created by the operator if the operator rotates the thumb wheel 30 in a direction to increase the distance between the side guides to facilitate loading the media. The predetermined distance is a matter of design choice based on the types of media items involved and the specific design of the feeder equipment.

The system described above can be automated. For example, both the adjustment of the adjustment thumb wheel 30 and the rack and pinion motion associated with the cover 62, could be accomplished by actuators such as motors or solenoids, which will do the adjustments automatically. The same two requirements to align the stack and eliminate the drag forces are met in the following manner. After the operator has loaded a stack of media and before the feed cycle is initiated, the motor drives the side guides through a drive mechanism, that may be similar to the type of mechanism previously described, until the side guides have moved toward each other sufficiently to align the media stack. The drive mechanism may include a slip clutch similar to clutch 32 or have a maximum torque output of the drive motor, which would stall when the torque is reached. These approaches limit maximum drive force on the side guide(s) but provide a force, which is sufficient to align the media stack. However, the side guides cannot be pressed too tightly against the stack thereafter. The motor then reverses a distance sufficient to back off the side guides away from the stack the same small distance above, for example about 0.5 mm.

A semi-automatic variation also applies. Either of the two steps could be automated with the other step remaining manual operation performed by the operator. For example, the adjustment wheel 30 with slip clutch 32 could be used to move the side guides against the stack and provide stack alignment but moving the guides away from the stack could be provided by an automated mechanism. The motor function described above could be used only for this second step. Alternatively, a solenoid-operated ratcheting mechanism arrangement could be employed to turn the lead screw 18 a defined amount in either direction.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. A media feeder for feeding media items from a stack of media items, comprising:

a media feed means for separating and feeding a single media item from a stack of media items;

a media elevator platform moveable toward and away from said media feed means;

a first and a second moveable media side guide mounted adjacent said media elevator platform;

a side guide adjustment mechanism connected to said first and second side guides such that when said side guide adjustment mechanism is moved in a first direction said first and second side guides will move toward each other and when said side guide adjustment mechanism is moved in a second direction said first and second side guides will move away from each other;

a first drive means connected to said side guide adjustment mechanism operable to cause said side guide adjustment mechanism to move in said first and second directions wherein said first drive means includes a torque limiting mechanism, said first drive means connected through said torque limiting mechanism to said side guide adjustment mechanism; and, a second drive means connected to said side guide adjustment mechanism operable to cause said side guide adjustment mechanism to move a predetermined amount in said second direction such that a predefined gap is established between media on said platform and said first and said second moveable media side guides after said side guides are moved into engagement with said media.

2. A media feeder as defined in claim 1 in which the side guide adjustment mechanism includes a lead screw having a first portion with right hand threads operatively connected with said first side guide and a second portion with left hand threads operatively connected with said second side guide.

3. A media feeder for feeding media items as defined in claim 1 wherein said second drive means includes an operator moveable member that is moveable between a first position and second position and when moved from said first position to said second position causes said side guide adjustment mechanism to move a predetermined amount in said second direction.

4. A media feeder for feeding media items as defined in claim 3 wherein said second drive means is out of engagement with said side guide adjustment mechanism when said moveable member is in said first position and is in engagement with said side guide adjustment mechanism when said moveable member is in said second position.

5. A media feeder for feeding media items, comprising:

a media feed mechanism;

a housing having a cover hinged thereto;

a media elevator platform mounted within said housing for supporting media items, said media elevator platform moveable in a vertical direction toward and away from said media feed mechanism;

a first and a second media side guide mounted adjacent said media elevator platform, said side guides moveable in a horizontal direction;

a side guide adjustment mechanism connected to said first and second side guides such that when said side guide adjustment mechanism is moved in a first direction said first and second side guides will move toward each other and when said side guide adjustment mechanism is moved in a second direction said first and second side guides will move away from each other;

a first drive mechanism, said first drive mechanism connected to said side guide adjustment mechanism and operable to cause said side guide adjustment mechanism to move in said first and second directions; and, a second drive means connected to said housing cover and to said side guide adjustment mechanism and operable to cause said side guide adjustment mechanism to move in said first direction when said cover is opened and said second direction when said cover is closed.

6. A media feeder for feeding media items as defined in claim 5 wherein said first drive mechanism includes a torque limiting mechanism, said first drive mechanism connected through said torque limiting mechanism to said side guide adjustment mechanism.

7. A media feeder for feeding media items as defined in claim 5 wherein said second drive means connected to said housing cover and to said side guide adjustment mechanism includes a drive member which is out of engagement with said side guide adjustment mechanism when said cover is in said open position and is in engagement with side guide adjustment mechanism when said cover is moved to said closed position.

8. A media feeder as defined in claim 5 in which the side guide adjustment mechanism is a lead screw having a first portion with right hand threads operatively connected with said first side guide and a second portion with left hand threads operatively connected with said second side guide.

9. A media feeder for feeding media items as defined in claim 8 further including a first gear connected to said lead screw and a second drive means drive member including a second gear which engages said first gear when said cover is closed and is out of engagement with said first gear when said cover is open.

10. A media feeder for feeding media items as defined in claim 9 wherein said first gear is a pinion gear and said second gear is a rack gear.

11. A media feeder for feeding media items as defined in claim 8 wherein said first drive mechanism includes a torque limiting mechanism, said first drive mechanism connected through said torque limiting mechanism to said lead screw, and including a first gear connected to said lead screw and a second drive means drive member including a second gear which engages said first gear when said cover is closed and is out of engagement with said first gear when said cover is open.

* * * * *